US005542486A

United States Patent [19]

Curlett

[11] Patent Number: 5,542,486

[45] Date of Patent: Aug. 6, 1996

[54] METHOD OF AND APPARATUS FOR SINGLE PLENUM JET CUTTING

[75] Inventor: Harry B. Curlett, Dallas, Tex.

[73] Assignee: CCORE Technology & Licensing Limited, Dallas, Tex.

[21] Appl. No.: 206,481

[22] Filed: Mar. 4, 1994

Related U.S. Application Data

[63] Continuation-in-part of Ser. No. 38,944, Mar. 29, 1993, Pat. No. 5,291,957, which is a continuation of Ser. No. 577,501, Sep. 4, 1990, Pat. No. 5,199,512.

[51] Int. Cl.[6] ..... E21B 7/18

[52] U.S. Cl. ..... 175/424; 175/67; 175/393

[58] Field of Search ..... 175/67, 40, 50, 175/69, 70, 329, 393, 418, 424; 299/81

[56] References Cited

U.S. PATENT DOCUMENTS 2,815,248 12/1948 O'Brien ..... 299/114
3,112,800 12/1963 Bobo ..... 175/67

(List continued on next page.)

FOREIGN PATENT DOCUMENTS 482911 11/1970 Switzerland .

OTHER PUBLICATIONS

Rector, et al., "Extending VSP to 3–D and MWD," *Oil and Gas Journal,* Jun. 19, 1989, pp. 55–58.

Dickinson, et al., "Conical Water Jet Drilling," *Proceedings of the Fourth U.S. Water Jet Conference,* pp. 89–96, Aug. 28, 1987.

Killalea, "High Pressure Drilling System Triples ROPS, Stymies Bit Wear," *Drilling,* Mar./Apr. 1989, pp. 10–12.

Sneddon, et al., "Recent advances in Polycrystalline Diamond (PCD) Technology, etc.," *Society of Petroleum Engineers,* 1987, pp. 487–498.

Geier, et al., *Water Jet–Assisted Drag Bit Cutting in Medium Strength Rock,* 1987.

Maurer, et al., "Laboratory Testing of High Pressure, High Speed PDC Bits," *Society of Petroleum Engineers SPE* 15615, 1986.

Mazurkiewiez, et al., "A Model Study of the Water Pressure, etc.," International Symposium on Jet Cutting Technology, Paper 18, Sep. 1986, pp. 189–193.

Deily, et al. "Five Wells Test High Pressure Drilling," *The Oil and Gas Journal,* Jul. 4, 1977, pp. 74–81.

Crow, "The Effect of Porosity on Hydraulic Rock Cutting," *Int. J. Rock Mech. Min Sci & Geomech Abstr.,* vol. II, pp. 103–105, 1974.

Feenstra, et al., "Tests Show Jet Drilling Has Promise," *The Oil and Gas Journal,* Jul. 1, 1974, pp. 45–57.

Chanaud, "Experiments Concerning the Vortex Whistle," 1963, pp. 953–960, Acoustical Society of America, J. Acoust. Soc. Am.

Johnson, Jr., et al., "The Development of Structured Cavitating Jets for Deep–Hole Bits," *Society of Pet. Engr. SPE 11060.*

"New Gulf Method of Jetted–Particle Drilling Promises Speed and Economy," *The Oil and Gas Journal,* Jun. 21, 1971.

Lichtarowicz, "Jet Cutting Technology", *Kluwer Academic Publishers,* 101 Philip Drive, Norwell, MA 02061, 1992.

"More Than Just the Right Tools," DBC General Catalog (Date Unknown).

Peterson, et al., "A New Look at Bit Flushing," Gas Research Institute, Aug., 1990.

*Primary Examiner*—Terry Lee Melius
*Attorney, Agent, or Firm*—Jenkens & Gilchrist, P.C.

[57] ABSTRACT

A high-speed fluid/mechanical jet erosion system utilizing a high-velocity, jet stream discharged contiguous the surface to be cut. The jet stream is developed from a single plenum flow system adapted to merge and enhance the erosive high-speed fluid jet characteristics of fluid with cavitational collapse erosion. The system further includes a tapered drill bit housing, with mechanical cutters therealong which places a generally axially centered, exiting jet immediately against the target formation, providing maximum mechanical and fluid energy transfer to the formation.

13 Claims, 10 Drawing Sheets

U.S. PATENT DOCUMENTS

| | | | |
|---|---|---|---|
| 3,251,424 | 5/1966 | Brooks | 175/56 |
| 3,324,957 | 6/1967 | Goodwin et al. | 175/67 |
| 3,326,473 | 6/1967 | Wahlin | 239/468 |
| 3,385,386 | 5/1968 | Goodwin et al. | 175/422 |
| 3,389,759 | 6/1968 | Mori et al. | 175/258 |
| 3,414,070 | 12/1968 | Pekarek | 175/393 |
| 3,417,829 | 12/1968 | Acheson et al. | 175/67 |
| 3,424,255 | 1/1969 | Mori et al. | 175/60 |
| 3,469,642 | 10/1969 | Goodwin et al. | 175/393 |
| 3,528,704 | 9/1970 | Johnson | 299/14 |
| 3,542,142 | 11/1970 | Hasiba et al. | 175/67 |
| 3,545,552 | 12/1970 | Angona | 175/65 |
| 3,548,959 | 12/1970 | Hasiba | 175/393 |
| 3,603,410 | 9/1971 | Angona | 175/65 |
| 3,838,742 | 10/1974 | Juvkam-Wold | 175/380 |
| 4,125,226 | 11/1978 | Nieuwkamp | 239/468 |
| 4,131,236 | 12/1978 | Saunders | 239/589 |
| 4,174,759 | 11/1979 | Arbuckle | 175/67 |
| 4,185,706 | 1/1980 | Baker, III et al. | 175/340 |
| 4,244,521 | 1/1981 | Guse | 239/110 |
| 4,262,757 | 4/1981 | Johnson, Jr. et al. | 175/67 |
| 4,280,735 | 7/1981 | Lobbe | 299/81 |
| 4,306,627 | 12/1981 | Cheung et al. | 175/422 |
| 4,337,899 | 7/1982 | Selberg | 175/424 |
| 4,359,115 | 11/1982 | Cagnionele | 175/393 |
| 4,389,071 | 6/1983 | Johnson, Jr. et al. | 299/14 |
| 4,391,339 | 7/1983 | Johnson, Jr. et al. | 175/393 |
| 4,474,250 | 10/1984 | Dardick | 175/50 |
| 4,474,251 | 10/1984 | Johnson, Jr. et al. | 175/67 |
| 4,534,427 | 8/1985 | Wang et al. | 175/67 |
| 4,542,798 | 9/1985 | Madigan | 175/340 |
| 4,610,321 | 9/1986 | Whaling | 175/67 |
| 4,624,327 | 11/1986 | Reichman | 175/67 |
| 4,660,773 | 4/1987 | O'Hanlon | 239/596 |
| 4,664,314 | 5/1987 | O'Brien et al. | 239/469 |
| 4,681,264 | 7/1987 | Johson, Jr. | 239/589.1 |
| 4,687,066 | 8/1987 | Evans | 175/340 |
| 4,694,916 | 9/1987 | Ford | 175/249 |
| 4,694,918 | 9/1987 | Hall | 175/329 |
| 4,723,612 | 2/1988 | Hicks | 175/393 |
| 4,733,735 | 3/1988 | Barr et al. | 175/393 |
| 4,759,415 | 7/1988 | Pessier | 175/340 |
| 4,765,687 | 8/1988 | Parrott | 299/81 |
| 4,787,465 | 11/1988 | Dickinson et al. | 175/67 |
| 4,852,668 | 8/1989 | Dickinson, III et al. | 175/67 |
| 4,858,707 | 8/1989 | Jones et al. | 175/329 |
| 4,902,073 | 3/1990 | Tomlinson et al. | 299/81 |
| 5,217,163 | 6/1993 | Henshaw | 175/67 X |
| 5,297,639 | 3/1994 | Schneider et al. | 175/67 X |

FIG. 1
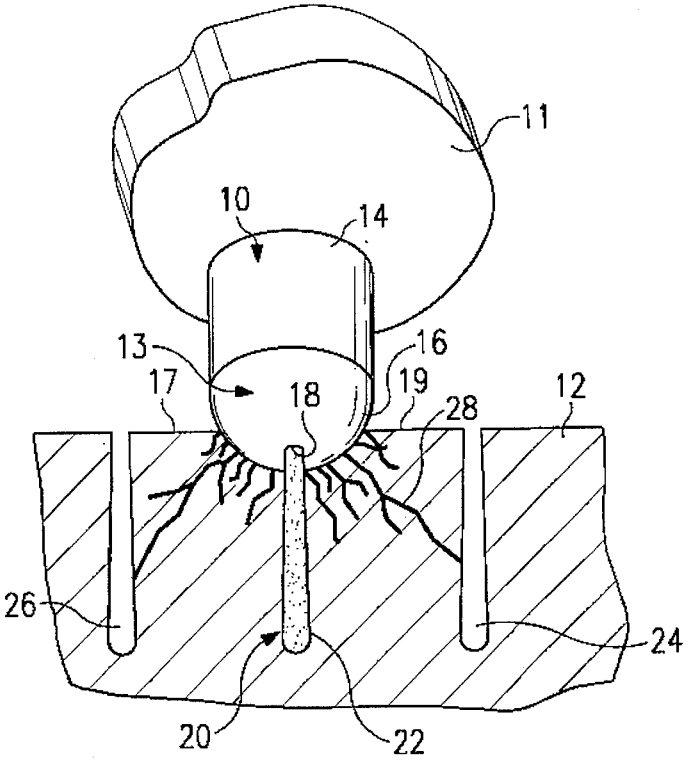
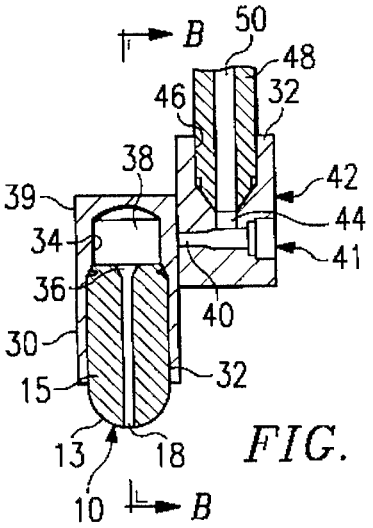
FIG. 2B
FIG. 2C
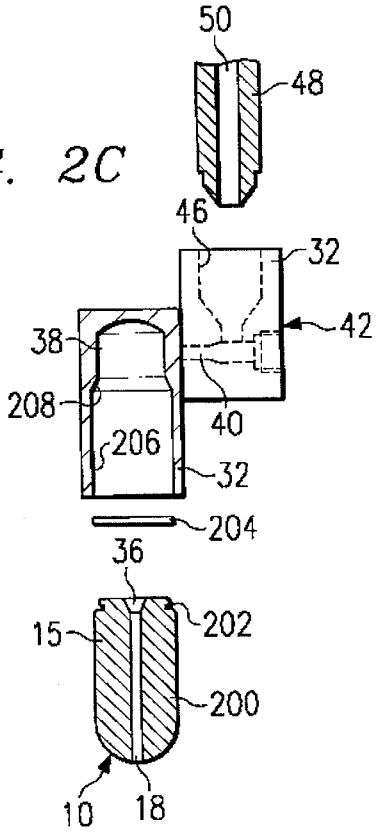
FIG. 2A
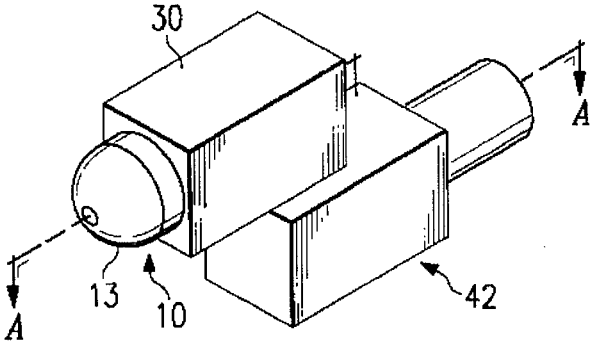

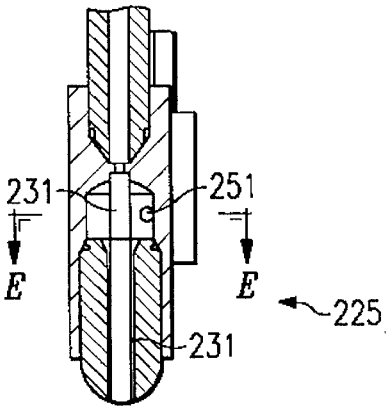
FIG. 7D
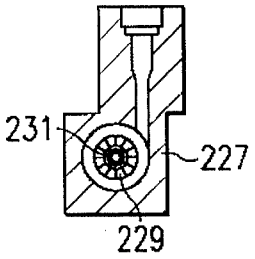
FIG. 7E
FIG. 8A
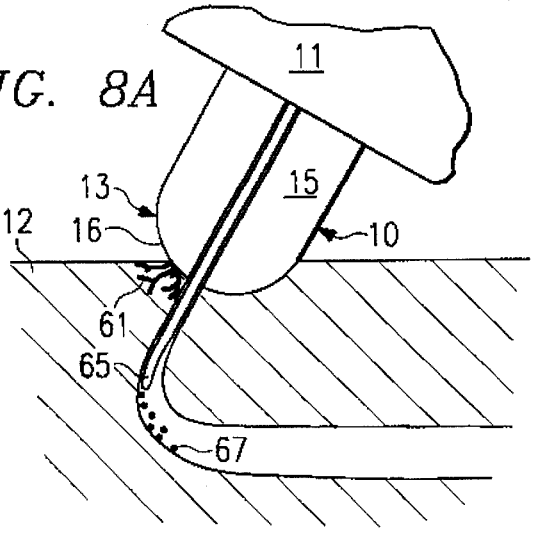
FIG. 8B
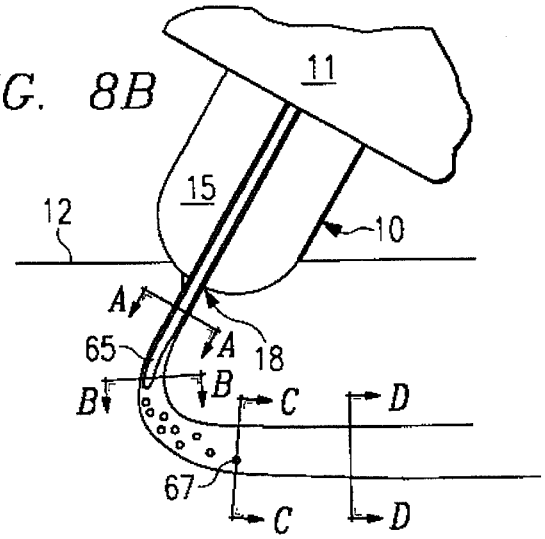
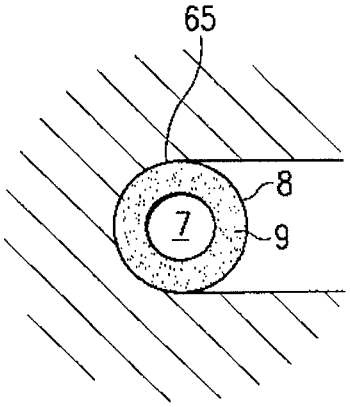
FIG. 8C
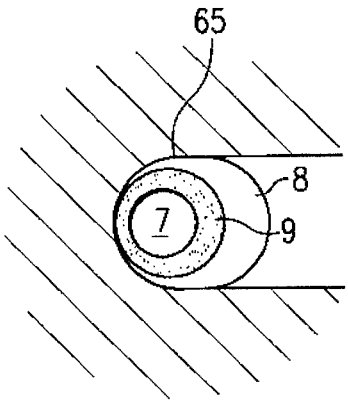
FIG. 8D

METHOD OF AND APPARATUS FOR SINGLE PLENUM JET CUTTING

The present application is a Continuation-In-Part of U.S. Patent application Ser. No. 08/038,944 filed Mar. 29, 1993 now U.S. Pat. No. 5,291,957, which is a Continuation of U.S. Pat. No. 5,199,512, now U.S. Patent application Ser. No. 07/577,501, filed Sep. 4, 1990.

BACKGROUND OF THE INVENTION

1. Field of the Invention

The present invention relates to jet cutting systems and, more particularly, to a method of and apparatus for producing a generally axially disposed erosive cutting jet stream for drilling, boring and the like.

2. History of the Prior Art

The prior art is replete with designs for mechanical cutting systems used to break, fracture and/or shear formations for the penetration thereof. Examples of such systems include modern-day drill bits of the type used for drilling deep well bores for the oil and gas industries. The most critical problem associated with the mechanical cutting of formations is untimely stress corrosion or thermal degradation failure of the materials used as the cutting means. Such material failure limits the ability of the operator to transfer high mechanical energy to the mechanical cutters. These problems create financial as well as physical limitations for commercially available drilling systems. In essence, the subterranean formation must be capable of cost effective penetration, which requires efficient energy transfer.

The search for a more efficient energy transfer system has resulted in a number of recent inventions and developments in drilling, boring and cutting systems. For example, the development of hydraulic erosion jetting mechanisms has, over the last 50 years, been the subject of increased interest. This design direction is due to the attributes of hydraulic erosion jetting, which include more efficient energy conversion to the work surface and a potentially ideal working medium, typically water, which is in great abundance and therefore economically expendable. Moreover, the technique is conceptually simple.

Hydraulic erosion of earthen formations is a technology that has been analyzed and reported in numerous publications. The erosion takes place by employing various failure mechanisms of the work surface induced by action of the liquid jet. The types of failure mechanisms that have been reported include; (1) failure of porous rock due to stress induced through liquid filled pore spaces of the rock brought about by impacting the liquid contained in the pore space; (2) formation failure by crack propagation and/or extension due to hydraulic fracture forces occurring when a liquid filled fracture is forced to close after an initial mechanical force is released; (3) liquid jet droplet impingement that erodes the cementation between formation grains thereby loosening and dislodging the harder formation grains. This last stated technique is known as Soft Erosion and is the typical mechanism present when eroding formations where the impinging jet stagnation pressures do not exceed the threshold pressures required to fracture the rock and thereby force large scale permeability in the in situ formation.

Other types of formation failure include (4) droplet impingement, known as Hard Erosion, that fractures the rock grains and the cementation by exceeding the threshold pressures necessary to fracture the formation grains and force large scale permeability by breaking the individual grains away from the formation; and (5) liquid jet induced pressure reversals that allow the in situ formation pore pressures to force tensile failure of the cementation holding rock grains together.

Prior art investigations and applications of erosive jet cutting have shown that liquid jets can be very effective in eroding rocks. The investigations have covered the broad modes of jet operation classed as continuous jets, interrupted jets, cavitating jets and abrasive particle jets. In each broad category there are a multiplicity of variations of the jets that have been investigated to focus on a predominant operational feature of the jet mode. Examples of these investigations are found in the following articles: "Tests Show Jet Drilling Has Promise", Feenstra, R. , et al, The Oil and Gas Journal, Jul. 1, 1974, "The Effects of Porosity on Hydraulic Rock Cutting", Crow, S. C., International Journal of Rock Mechanics, Mining, Science & Geomechanics Abstract, Vol. 11, pp. 103–105. Pergamon Press 1974 and "A Model Study of the Water Pressure Distribution in a Crack when Impacted by a High Pressure Water Jet", Mazurkiewicz, Dr. M. et al, 8th International Symposium on Jet Cutting Technology, Durham, England: 9–11 September, 1986. In addition, references to cavitation and particle abrasion, respectively, may be seen in the following articles: "The Development of Structured Cavitating Jets for Deep-Hole Bits" by Virgil E. Johnson, Jr., Georges L. Cahine, William Lindenmuth, Andrew F. Carr and Gary S. Frederick, Hydronautics, Incorporated and George J. Giacchino, Jr. NL/HYCALOG/NL Industries, Inc., Society of Petroleum Engineers or AIME Paper 11060, 1982; and "New Gulf Method of Jetted-Particle Drilling Promises Speed and Economy," *The Oil and Gas Journal* Jun. 21, 1971.

A number of problems are associated with erosive jet cutting systems. One of the problems that limits the optimum performance of the jet has been the inability to provide reliable means for maintaining a specific distance between the jet nozzle and the target formation. In prior art designs, it has been deemed necessary to control the distance between the nozzle and the target formation in order to properly focus the energy of the jet streams. In order to address this problem, most nozzles have been recessed from the cutting surface by several nozzle diameters in order to allow the nozzle to survive the rigors of the cutting environment while others have been recessed to allow maturation of the erosive jet mode to develop. It has been noted, however, that the splash back erosion against the tool caused by the jet action then becomes a serious problem. Additionally, there is typically an exponential energy decay with increased standoff distances. A number of prior art patents have addressed these various concerns, and the teachings of these patents are illustrative of several problems in erosive cutting jet systems.

U.S. Pat. No. 4,787,465, entitled Hydraulic Drilling Apparatus and Method, is a 1988 patent teaching a drilling apparatus producing a whirling mass of pressurized cutting fluid to create a high-velocity cutting jet. The cutting action is enhanced by abrasive material in the drilling fluid. This technology is further discussed in U.S. Pat. No. 4,852,668, which is a 1989 patent issued to the same inventors. The cutting nozzles disclosed in these patents employ an axial conical spray that predominantly uses the development of a thin sheet of high speed liquid drops that develop within the conical spray and erode through liquid drop impingement of the target formation granule cementation and thereby dislodge formation grains as discussed above. These grains are then carried into a reentry torodial flow motion, which is perpendicular to the axis of the conical spray, that further uses the grains for an in situ abrasive to abrade and dislodge further particles. The stated purpose of this conical jet is to hydraulically drill a hole of a diameter larger than the drill head and its supply/transport tube without rotating the system. This aspect is more fully set out in the article "Conical Water Jet Drilling", Dickenson, W. et al, Proceedings of the Fourth U.S. Water Jet Conference.

Various attempts to combine the positive aspects of mechanical cutting means and hydraulic erosion jetting means have also been reported. Several references may be seen in "Five Wells Test High-Pressure Drilling", Deily, F. H. et al, The Oil and Gas Journal, Jul. 4, 1977; "Laboratory Testing of High Pressure, High Speed PDC Bits"— W. C. Maurer and W. J. McDonald, Maurer Engineering, Inc.; J. H. Cohen, Drilling Research Center, Inc.; J. W. Neudecker Jr., Los Almos National Laboratory; and D. W. Carroll, U.S. Air Force—SPE Paper 15615, "Water-Jet-Assisted Drag Bit Cutting in Medium-Strength Rock", Geier, J. E. et al, United States Department of the Interior Information Circular 9164 and "High Pressure Drilling System Triples ROPS, Stymies Bit Wear" Mike Killalea, Editor—Drilling, March/April 1989.

Additional development efforts in combining mechanical cutting and hydraulic erosion jetting means are seen in U.S. Pat. No. 3,838,742 issued to Juvkam-Wold and U.S. Pat. No. 4,391,339 issued to Johnson. The Juvkam-Wold patent teaches the use of a fluid/mechanical system incorporating abrasive resistant nozzles recessed in a mechanical drill bit adapted for discharging a high velocity stream of abrasive laden liquid through the nozzles. The Johnson patent teaches an improved technique utilizing recessed nozzles adjacent mechanical cutting surfaces, wherein the nozzles discharge a cavitating liquid jet. This patent, which references the Juvkam-Wold patent, further teaches one technique of maintaining a controlled distance between the cavitating jet nozzles and the surface to be cut by using exposed diamond wear buttons and a pre-select nozzle recess distance wherein maximum cavity collapse is said to occur. The recess also serves an apparent purpose of protecting the nozzle. A further discussion of the use of structured shedding vortex rings created in the shear zone between the jet and the spent liquid in the hole, wherein vapor cavities are formed, may also be seen. The application of vortex ring cavitation has thus been recognized to be effective in such fluid/mechanical cutting systems.

As referenced above, the combination of high speed fluid jet cutting in mechanical drilling systems has clearly been the subject of continued development for cutting systems. This type of combination has been shown to demonstrate superior efficiencies when compared to purely hydraulic erosion drilling means. However, a number of problems still plague the industry, which problems prevent a reliable and efficient high-speed cutting jet. It would be an advantage, therefore, to utilize the positive aspects of high-speed jet cutting in a fluid/mechanical system that is both reliable and devoid of the critical problems of the prior art. The present invention provides such a system by utilizing a high-speed spinning jet stream with a single or multiple axial plenum erosive cutter produced from the end of a tapered housing.

SUMMARY OF THE INVENTION

The present invention pertains to methods of and apparatus for high-speed fluid jet cutting. More particularly, one aspect of the present invention relates to a single plenum erosive cutter drill bit. The cutter is formed with a tapered housing having a plurality of cutter bodies disposed outwardly thereof and a central aperture formed therethrough. The aperture is constructed for producing a center jet, cavitational discharge for inducing erosion in the surface being cut. The assembly combines the mechanical and hydraulic advantages of a center jet cavitational erosive cutter in combination with high stress mechanical crushing elements formed in the cutter bodies extending outwardly from the tapered housing to improve down-hole drilling dynamics. The tapered shape of the housing in conjunction with the erosive jet cutter is provided to dynamically dampen the drilling forces through superior horizontal and vertical drill bit stabilization in the hole, minimizing lateral and vertical vibrational forces of the drill bit.

In another aspect, the invention includes an improved method of eroding a surface with a drill bit and inducing fracture therein with both mechanical cutting with the drill bit and a high speed liquid jet of the type wherein the high speed liquid jet is formed for impingement against the surface. The improvement comprises the steps of providing a drill bit housing having at least one central bore formed therein, injecting liquid into the bore, inducing the liquid to swirl within the bore, and discharging the swirling liquid from a centrally disposed orifice positioned in flow communication with the bore to form a high speed swirling liquid jet. The discharged swirling liquid jet is disposed contiguous to the surface for the creation of an erosion therein while the drill bit is rotated with the discharging jet eroding the surface therebefore.

In another aspect, the above described invention includes the forming a tapered drill bit housing, positioning the orifice at the narrow, tapered end of the housing, and mechanically inducing fracture propagation of the eroded region of the surface with the tapered drill bit housing. A liquid swirl inducer may also be provided within the drill bit housing for forming the jet by passing liquid through the liquid swirl inducer. The lower region of the base of the housing may also be formed with a tapered chamber region adapted for increasing the velocity of the swirling liquid passing through the swirl inducer. The drill bit housing may also be formed with an outside taper with mechanical cutting elements about the tapered housing, with the orifice formed at a narrow tapered end of the housing. In this configuration, the rotation of the housing enlarges the hole in the surface being penetrated after erosion thereof by the swirling liquid jet. In one embodiment of the invention synthetic polycrystalline diamonds are secured in the narrow, tapered end of the housing for mechanically inducing fracture propagation of the surface being penetrated.

In yet another aspect, the invention includes an improved cutting tool for the erosion of a surface, the tool being of a type wherein a liquid jet is discharged from the tool to create an eroded region. The improvement comprises a tapered tool body having a single central discharge nozzle disposed therein, a plurality of mechanical cutting elements secured about the tapered housing and a discharge nozzle forming the distal end of the tool for initial engagement with the surface. A tapered chamber is formed in the tool body and disposed in flow communication with the nozzle. Means are provided for creating a liquid swirl within the tapered chamber. Means are also provided for discharging the liquid swirl from the chamber and through the nozzle against the surface for the erosion thereof. Means are then provided for rotating the tool during discharge of the liquid jet. The liquid swirl creation means may comprise a stator disposed in flow communications with the tapered chamber for the generation of a liquid swirl therein, and the stator may be disposed within a generally cylindrical chamber formed within the tapered chamber.

BRIEF DESCRIPTION OF THE DRAWINGS

For a more detailed description of the construction and operation of the present invention, reference is now made to the following description taken in conjunction with the accompanying drawings, in which:

FIG. 1 is a perspective view of a tangentially driven vortex jet tool in engagement with a formation;

FIGS. 2A through 2E are multiple views of one embodiment of the vortex jet nozzle of FIG. 1, illustrating the assembly thereof;

FIGS. 7A through 7E are views of an alternative embodiment of a vortex jet configuration adapted for utilizing a separate abrasive particle fluid stream to increase the effective erosive power thereof;

FIGS. 8A and 8B are side elevational, cross-sectional views of the vortex jet tool of FIG. 1 illustrating further aspects of the operation thereof, and for which cross-sectional views FIGS. 8C–8F are taken about lines A—A, B—B, C—C, and D—D of FIG. 8B and illustrated therewith;

DETAILED DESCRIPTION OF THE DRAWINGS

Figure 2D:
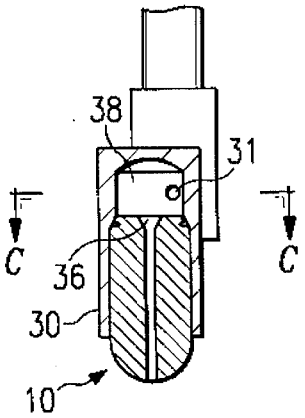

Referring first to FIG. 1, there is shown a fragmentary perspective view of one embodiment of a vortex jet wear nozzle 10 engaging an earthen formation 12 and penetrating said formation. In this view, a cutting nose 13 of the wear nozzle 10 is shown protruding from a housing 11. The nose 13 includes a generally cylindrical body 14 and a hemispherical head region 16 which is constructed to extend from the support housing 11, such as a drill bit (not shown), for direct engagement of the surface 12 to be eroded. In the center of hemispherical head 16 a discharge aperture 18 is formed therethrough. A high-velocity vortex jet 20 is therein illustrated being discharged from aperture 18 in deep penetration of the formation 12 creating a kerf, or cut region 22, therein. Open kerfs 24 and 26 are shown adjacent kerf 22. Also shown adjacent the kerf 22 and the hemispherical head 16 of the cutting nose 13 are fracture lines 28, illustrating one aspect of the operation of the wear nozzle 10.

Still referring to FIG. 1, the wear nozzle 10 is constructed to produce a swirling discharge 20 from nose 13 of sufficient velocity and energy to selectively erode the formation 12. Further illustrations of both the erosive action and the vortex stream are provided herein. Before addressing such flow characteristics, however, it is necessary to understand the actual construction of the vortex nozzle 10 as well as the theoretical operation thereof. This is due to the fact that the present invention pertains to a single plenum jet cutter which produces a single discharge jet.

Referring now to FIG. 2A, there is shown a perspective view of one embodiment of the nozzle 10, as it would be assembled in the housing 11 of FIG. 1. The cutting nose 13 is thus seen to depend from wear nozzle housing 30. The wear nozzle housing 30, constructed of stainless steel, or the like, is best shown in FIG. 2B, which is a side elevational, cross-sectional view of the nozzle 10 of FIG. 1, taken along lines A—A thereof. As seen in this side elevational, cross-sectional view of the assembled vortex nozzle 10, housing assembly 30 includes an elongate jet cutter 15, the end of which forms cutting nose 13. The cutter 15 is received within a sleeve 32, of housing 30, in press fit engagement therewith. Cutter 15 can also be engaged in housing 30 by soldering, welding or employing mechanical means other than a press fit. Irrespective of the manner of securement, a discharge aperture 18 is shown to be constructed axially through the cutter 15, terminating at one end in nose 13 and at the other end in an upper feed region 34. In the upper feed region 34, the discharge aperture 18 forms an enlarged funnel region 36, which funnel region 36 is disposed adjacent a generally cylindrical cavity 38 formed within a head region 39 of housing 30. The head 39 is disposed adjacent to block 42. Block 42 is constructed adjacent sleeve 32 and is constructed with a passage 40 for the passage and tangential injection of liquid into cavity 38, as best illustrated in FIG. 2E. Passage 40 also includes an upstanding port 44, disposed in flow communication with a generally cylindrical recess 46. A tooling access port 41 is shown for reference purposes, as such access would generally be required for drilling the tangential passage 40 as shown in this particular embodiment. Cylindrical recess 46 has received therein a feedline 48, having a flow passage 50 formed axially therethrough. Liquid carried by feedline 48 thus discharges liquid from passage 50 into port 44 and passage 40 for tangential injection into cavity 38. The manner of tangential entry into cavity 38 and the methods and apparatus thereof will be described in more detail below. Likewise, further description of the nozzle 10, the jet cutter 15, and housing 30 will be described in more detail below after first addressing certain operational principles thereof.

Figure 3A:
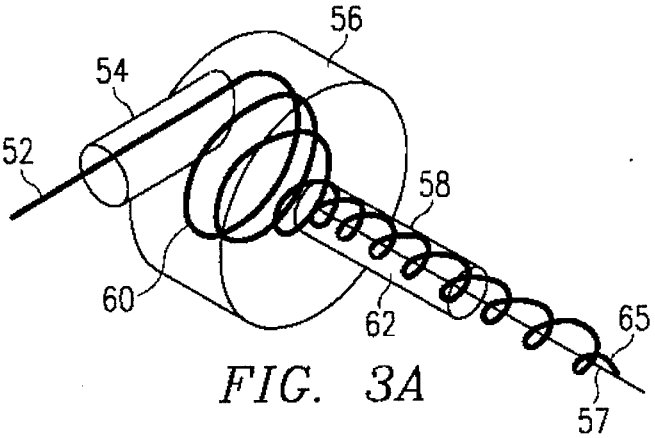
FIGS. 3A through 3D are diagrammatical illustrations of the theoretical operation of a vortex generator and jet for the nozzle of FIG. 1, including a pressure/velocity distribution curve therefor.

Referring now to FIG. 3A, there is shown the conceptual components and operation of a device known as a vortex whistle. This device is more fully described by the investigations of Robert C. Chanuad and discussed in the article entitled "Experiments Concerning the Vortex Whistle," by the Acoustical Society of America in 1963. The article describes various relationships of tangentially introduced flow into a swirl chamber, which flow is exhausted through a relatively small diameter exhaust tube. The phenomenon of high-speed vortex flow is a functional component of the present invention. The phenomenon is produced by tangential flow 52, which passes through a tangential supply line 54. The supply line 54 is connected to the swirl chamber 56, which is shown as a generally cylindrical cavity (such as cavity 38 described above). Axially connected to the swirl chamber 56 is a discharge tube 58. As the flow 52 is forced into the swirl chamber 56 and the flow 52 conforms with the swirl chamber configuration, it is continually forced into an ever-decreasing radius of rotational flow as represented by streamlines 60. The swirling flow 52 is further forced along the streamlines 60 until it flows inwardly toward the axis 57 of the exhaust tube 58. Throughout this pattern, the flow 52 increases its angular velocity in accordance with the law of the conservation of angular momentum.

Still referring to FIG. 3A, the flow 52 is subsequently forced into the exhaust tube 58 with the above referenced increased angular velocity. A simplistic description of the flow regime in the exhaust tube 58 is illustrated here as a tight helical flow 62 along the axis 57 of said exhaust tube. Further details of this flow regime will be provided below. As the helical flow 62 exits the exhaust tube 58, the flow 62 has been shown to precess. The flow processing phenomenon has been recognized in various studies. This phenomenon generates a pure vibrational tone with a frequency that is directly related to flow conditions. The frequency of this vibrational tone is approximately equal to the angular velocity of the flow 62 as it nears the exit of the exhaust tube 58. The sound produced will vary directly with fluctuation in flow 52. This is a recognized physical phenomenon as more fully set forth in the above referenced article by Chanuad entitled "Experiments Concerning the Vortex Whistle."

Figure 3B:
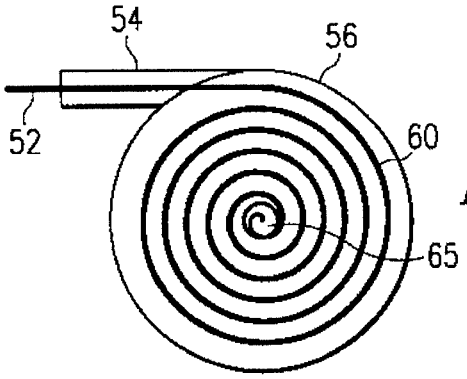

Referring now to FIG. 3B, there is shown a top plan view of the vortex whistle of FIG. 3A, illustrating the flow line therein. The flow 52 is thus shown to enter the supply pipe 54 for tangential entry into the swirl chamber 56. The pattern of flow 60 within the swirl chamber 56 is illustrated as a spiral in this particular view, which spiral terminates in central discharge region 65. The central discharge region 65 is, in actuality, a top plan view of the high-velocity rotational flow 62 described above. At this point it may be seen, however, that the angular velocity of the fluid will be magnitudes higher than the angular velocity of the fluid adjacent the supply pipe 54.

Figure 3C:
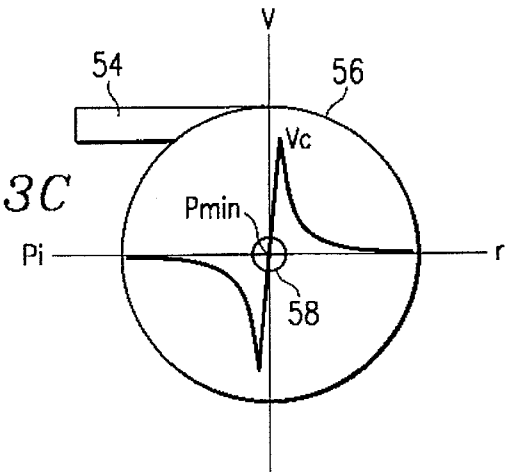

Referring now to FIG. 3C, there is shown, superimposed on top of a plan view of the swirl chamber 56, a Rankine line-type vortex velocity/pressure profile curve that illustrates spatial velocity and pressure relationships as a function of radii from the center of the said swirl chamber. The curve presented in FIG. 3C illustrates the premise above described, to wit that the closer one measures parameters of flow toward the center of the swirl chamber, the greater the velocity and pressure of the flow. This is true until a radius is reached, where a core of the rotating fluid acts like a solid rotating body with velocity and pressure decreasing as a function of a decreasing radius.

Figure 3D:
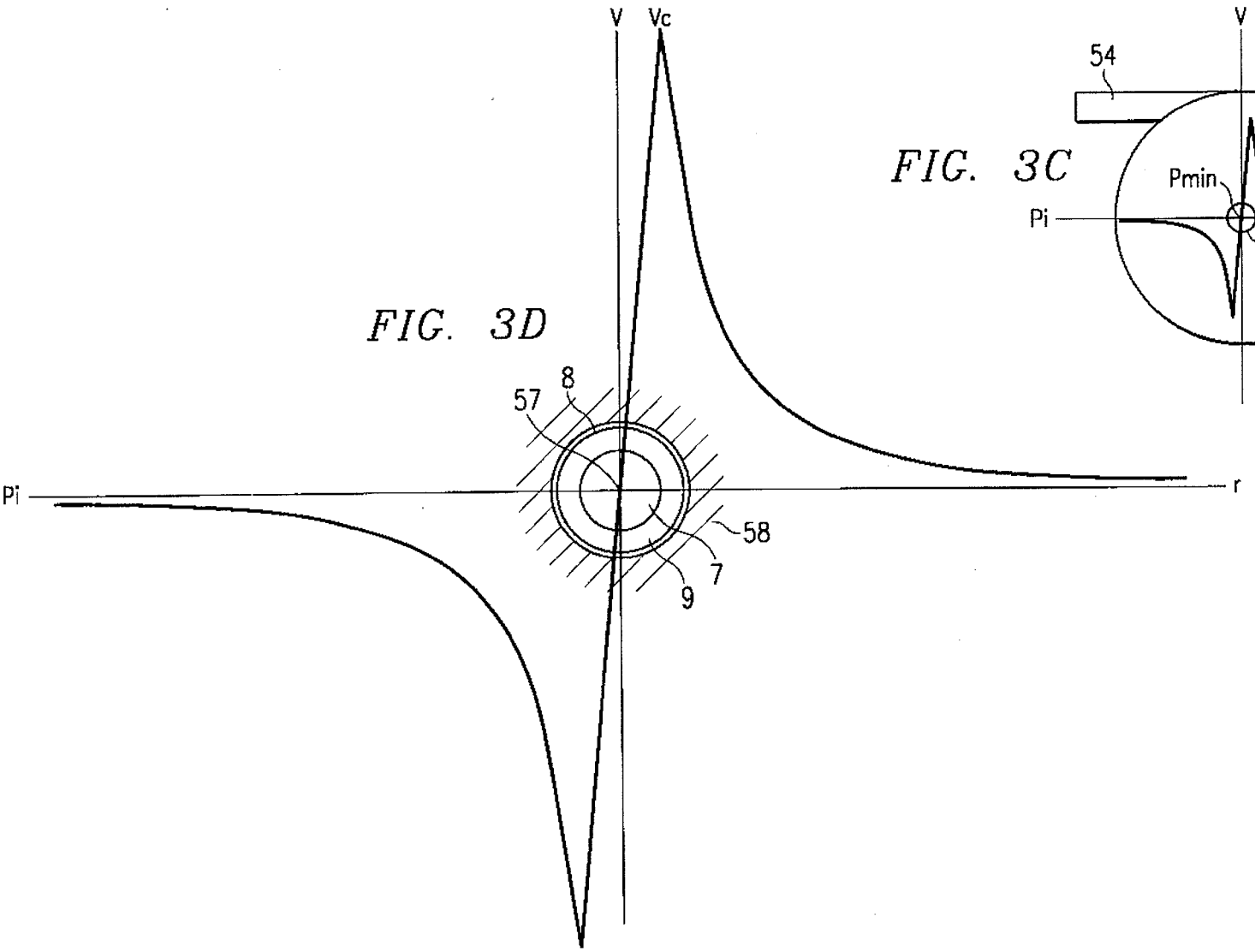

Referring now to FIG. 3D, an enlarged view of the Rankine line vortex velocity and pressure curve in spatial relation to the exit tube fluid flow is herein shown. The rotation flow entering the exhaust tube may seem to be conformed into three distinct flow regions: 7, 8 and 9. The flow of region 8 is a boundary layer flow and flows in a large helical manner in the axial direction of the exhaust tube 58. The flow region 9 is an annular flow region that exhibits relatively high velocity circumferential flow that has negligible relative movement associated with it in the axial direction of the exit tube 58. The next, flow region cavity 7 behaves as a solid body core flow field which flows in a helical manner in the axial direction of the exhaust tube 58. Region 7 exhibits the lowest velocities and pressure near its axis 57. The central region of this centermost core has a pressure that will typically drop below the vapor pressure of the liquid under high rotational speed conditions and therefore produce a vaporous cavity which can be either continuous or periodic. This combination of spinning flow regimes stabilizes quickly upon entering the exit tube 58 and will remain intact as flow pattern 65 for a distance beyond the exit tube end at high rotational speeds. The cross-sectional thickness of each region 8, 9 and 7, within the exit tube, will vary with the rotational speed and therefore is also a function of the axial distance from the swirl chamber 56. It is the hydrodynamic effects of these regions of flow that provide the basis for improved erosion of the formation as herein described. The method of use and application of these spinning vortex flow regions and the apparatus to generate this vortex flow in combination with a mechanical cutting means will thus be further described in more detail below.

Figure 4A:
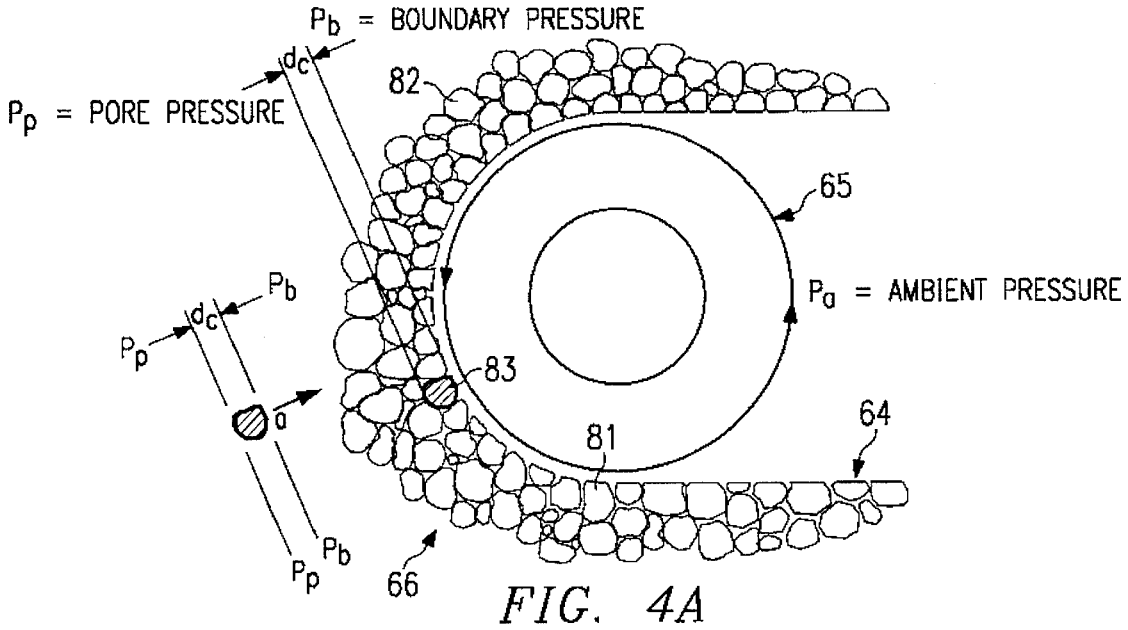
FIGS. 4A and 4B are enlarged diagrammatical illustrations of the dynamic erosive effects of the induced hydrodynamic pressure reversals and the dynamic erosive effects of the jet nozzle of FIG. 1 in operation against an earthen formation.

Referring now to FIG. 4A, there is shown an enlarged diagrammatic illustration of a vortex jet stream 65 of the type described above in engagement with an earthen formation 66. The earthen formation 66 is shown to be comprised of cemented grains 82 and particularly showing representative grains 81 on the boundary of a kerf wall 64 as they are being eroded by the vortex jet stream 65. The boundary layer of formation grains adjacent to and generally forming a semicircle in front of the vortex jet 65 is subjected to a pressure differential caused by low pressure area in the boundary between the vortex jet 65 and kerf wall 64. The pressure differential is relative to the formation pore pressure behind the boundary layer grains on the kerf wall 64. This relationship has been observed and is explained in U.S. Pat. Nos. 4,681,264 and 4,474,251, both is sued to Virgil E. Johns on, Jr. As explained in these references, one method of enhancing the erosive intensity of a high-speed liquid jet for cutting, drilling or otherwise acting on a formation comprises the steps of forming the jet and oscillating the velocity of the jet at a preferred Strouhal number and impinging the pulsed jet against a solid surface to be eroded. It is set forth in the Johns on '251 patent that if a cavitating liquid jet is excited so as to structure itself into discrete vortex rings, normal to the axial direction or the jet stream, such a liquid jet will cavitate more violently, increasing erosion. Harnessing the pressure differential over a radially spreading vortex ring as it is impinged and passes over the formation boundary provides for both axial and rotational forces acting to induce directional factors to improve the erosive result.

Figure 4B:
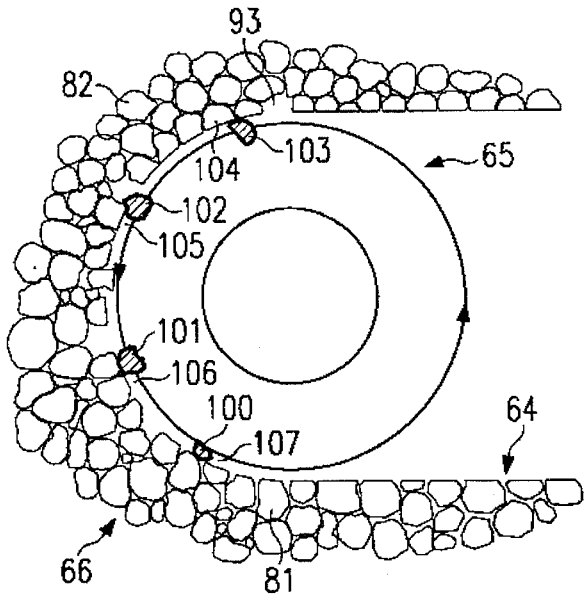

Referring now to FIG. 4B, there is shown an illustration of the expected results of the dislodging of the boundary layer particles due to the combination of rotational and axial flows that exploit the intergranular cementation stress cracking effected by boundary layer velocity induced pressure differentials. The subsequent entrainment of the dislodged formation grains, as illustrated by grains 100, 101, 102 and 103, are effectively used as an in situ abrasive to further impinge upon and abrade both the intergranular cementation and the grains themselves. A further benefit of the vortex action is the entrainment of the abrasive particles and allowing more abrasion to take place than would occur in a purely axial jet action.

Figure 5:
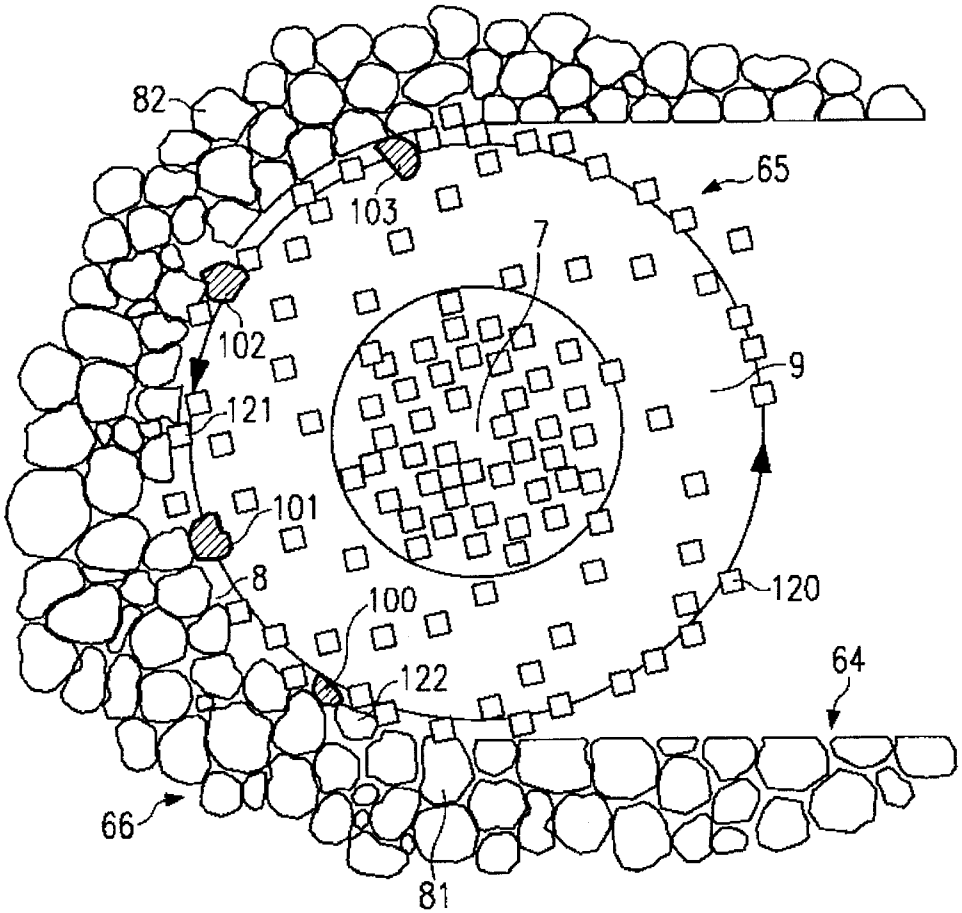
FIG. 5 is a further enlarged view of the dynamic erosive effects of FIG. 4A for a nozzle having a center-fed abrasive particle stream.

Referring now to FIG. 5, there is shown a cross-section of the vortex jet stream 65 with an abrasive particle stream introduced into the center core flow region 7. The abrasive particle stream provides an external source of abrasive material 120 as shown herein. An example of such an apparatus is further illustrated in FIG. 7 described below. As abrasive material particles 120 are centrifugally disbursed from core flow region 7 into flow region 9, they become entrained in the vortex jet action of flow region 9. Here abrasive particles 120 pick up energy and are subsequently impinged against the formation 66. Another benefit of the vortex action is the longer entrainment of the abrasive particles, such as silica flour, due to the rotational motion of the vortex jet which tends to provide a longer duration of single particle abrasion to take place than would occur in a purely axial jet action. Such a mechanism for supplying abrasive material into a fluid jet will be useful in many applications of material cutting.

As described above, the benefit of the vortex jet action is that it allows the introduction of a lower pressure abrasive slurry into the focussed jet stream to increase its cutting effectiveness without causing unacceptable erosion of the delivery equipment. Such a problem plagues prior art abrasive jet cutting systems. Moreover, the concept of injecting abrasives into the central region of the vortex jet can be utilized in various modes. For example, a high pressure axial jet can be additionally focussed for a greater distance from a nozzle exit by shrouding it with a liquid or gaseous co-axial vortex. Also, when cutting a porous material that is sensitive to liquid invasion, a gaseous vortex jet with a gaseous co-axial abrasive jet stream could be employed. As can be seen, there are many adaptations for using liquids, gases, combination of both, independently or combined with abrasive material.

Figure 6A:
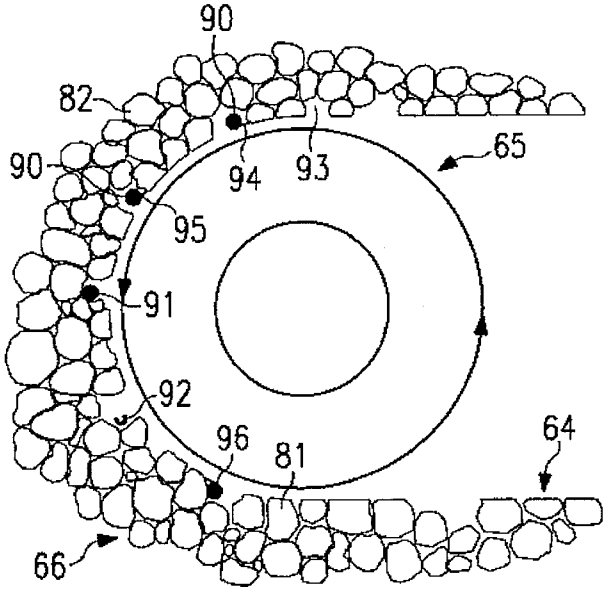
FIGS. 6A and 6B are diagrammatic illustrations of the dynamic erosive effects of hydrodynamically induced intergranular and center-core cavitation.

Referring now to FIG. 6, there is illustrated additional erosional mechanisms that would operate concurrently and in addition to the previously discussed pressure reversal-induced erosion. In FIG. 6A, there is illustrated a cross-section of the vortex jet stream 65 and the earthen formation 66 against which the vortex jet is being directed. The formation 66 is comprised of cemented grains 82. Representative grains 81 are shown on the boundary of the kerf wall 64 as it is cut by the vortex jet 65. The boundary layer of formation grains adjacent and generally forming a semicircle in front of the advancing vortex jet 65 are subjected to a pressure differential caused by a low pressure area in the boundary between the vortex jet 65 and kerf wall 64. As the vortex jet stream 65 is passed against the relatively uneven frontal surface voids 93 of the target formation, the formation 66 provides edged surfaces 94, 95 and 96 that promote hydrodynamic pressure reductions sufficient to produce cavitation in the fluid shear zone.

Cavitation, as used herein, refers to the formation and growth of vapor-filled cavities in a high velocity flowing stream of liquid where the local pressures surrounding the gas nuclei in the liquid are reduced below the pressure necessary for the nuclei to become unstable, grow and rapidly form relatively large vapor-filled cavities. This critical pressure is equal to, or less than, the vapor pressure of the liquid. When the local pressures surrounding the cavities rises sufficiently above the vapor pressure of the liquid, the cavities collapse and enormous pressure and potential destruction is created in the vicinity of this collapse. The effect on solids exposed to such collapsing cavities is called cavitational erosion. The single plenum cutter of the present invention utilizes this effect for eroding and penetrating the center of the bore hole in combination with the mechanical action of the cutter rotating therein.

The shear zone between the spinning vortex jet stream and the relatively stationary fluid in the pore spaces has been shown to create turbulent boundary layer incipient cavitation eddies and shedding vortices 90 which have low pressure regions in their centers that provide the conditions necessary for the development of cavitation. The cavitation bubbles 91 and 92 subsequently implode against the downstream formation surfaces attacking both the cementation and formation grains themselves. This phenomenon is discussed in part by S. C. Crow in his paper titled "The Effect of Porosity on Hydraulic Rock Cutting", International Journal of Rock Mechanics, Mining Science, and Geomechanics, Abstract Vol. 11, pp. 103–105.

Figure 6B:
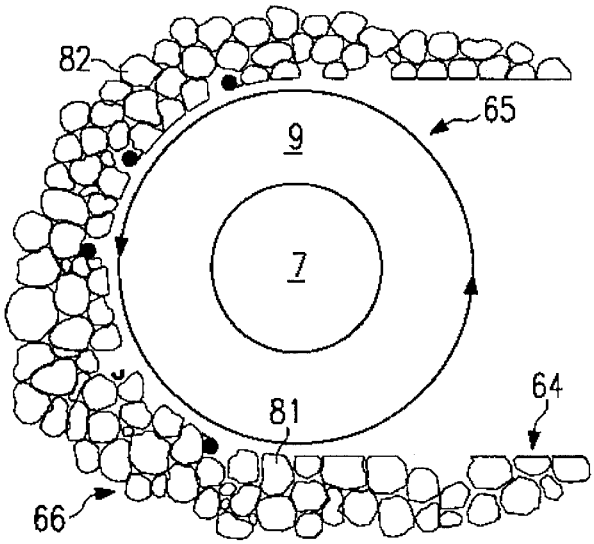
Figure 8E:
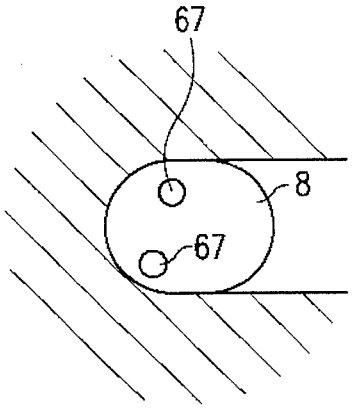

Illustrated in FIG. 6B is the cross section of the spinning vortex jet 65 which has formed a low pressure vortex cavity 7 containing water vapor. This center core vapor cavity will collapse when the spinning stream velocity is reduced to a point where the stream pressures will no longer permit the presence of a center core cavity. This point of collapse can be termed the "cavitation stagnation" point of the center core vapor cavity. At this cavitation stagnation point, the center core materially collapses causing substantial instantaneous pressure and temperature increases of sufficient magnitude to locally disintegrate the formation. If the fluid pressure surrounding the jet issuing from the nozzle-cutter is denoted as Pa and the pressure in the supply to the nozzle-cutter as Pn, the jet stream exiting from any nozzle will cavitate at low values of the ratio Pa(Pn-Pa), which is defined in the cavitation number. If this pressure relationship is reduced substantially below the value at which cavitation occurs in wake vortices, a long trailing vapor filled cavity forms and sheds vapor cavities from its tail, as illustrated in FIG. 8B discussed below. These vapor cavities are convected with the circumferential and axial degrading vortex flow to a point where they collapse against the formation in response to ambient pressure.

Having described the theory of operation in conjunction with the illustration of FIGS. 3 through 6, reference will again be directed back to FIGS. 2A and 2B. These drawings illustrate one embodiment of a nozzle cutter assembly more fully described in U.S. Pat. No. 5,199,512 of which this patent application is a Continuation-in-Part of a Continuation thereof. FIG. 2B is a cross-sectional view of the housing 30, showing the sleeve 32 to be of a generally cylindrical construction. Other assembly configurations are clearly contemplated by the present invention, as described below.

Referring now to FIG. 2C, there is shown an enlarged, diagrammatic, exploded, side elevational view of the assembly of nozzle 10. The nozzle cutter 15 is shown to be constructed of a generally bullet-shaped body portion 200 having an upper circumferential groove 202 formed therearound. Groove 202 is adapted for receiving an O-ring 204, or similar sealing member, therearound. Alternately the nozzle cutter 15 could be sealed with a metal to metal contact in this area. The upper, funnel region 36 that is described in FIG. 2B above is shown as a part of the discharge aperture 18. The body 200 may be constructed of a wear resistant material such as tungsten carbide. The inside walls 206 of sleeve 32 are shown to be constructed with a tapered region 208 leading into upper cylindrical cavity 38. The sleeve 32 may be constructed of a wear resistant material such as stainless steel or titanium. Cylindrical recess 46 is disposed adjacent block 42 and formed to receive feedline 48, having flow passage 50 formed therethrough.

Referring now to FIG. 2D, there is shown an end elevational, cross-sectional view of the housing 30 of FIG. 2B taken along lines B—B thereof. In this particular view, the upper cavity 38 illustrates an elliptical opening 31 comprising the tangential entry of passage 40 therein. From this tangential entry port fluid is injected for swirling flow. FIG. 2E further illustrates this constructional feature. FIG. 2E comprises a top plan view of the housing 30 of FIG. 2D taken along lines C—C thereof. In this view, the passage 40 is shown in direct flow communication with chamber 38, forming elliptical orifice 31 therein.

Figure 2F:
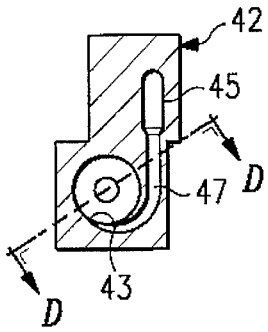
FIGS. 2F and 2G are views of an alternative embodiment of the vortex jet of FIGS. 2E and 2D.
Figure 2E:
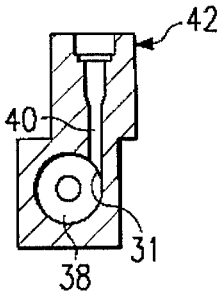
Figure 2G:
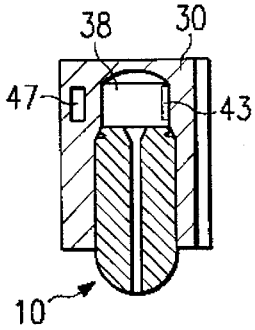

FIGS. 2F and 2G are alternative embodiments of the housing 30 of nozzle 10. In these views, a specific type of tangential injection, herein referred to as involuted injection, is provided by a rectangular passage 47. The involuted feed provides a transition from a circular feed passage 45 to the converging, rectangular passage shown in FIG. 2F. This figure comprises an alternative embodiment of FIG. 2E; while FIG. 2G is a side elevational, cross-sectional view of the nozzle and housing taken along lines D—D of FIG. 2F.

Still referring to FIGS. 2F and 2G, the structure therein affords numerous benefits relative to the flow characteristics of a the swirling, tangential system. The advantages of introducing a rectangular slot type feed into the vortex generator include the greater relative volume that can be fed into the generator without sacrificing angular velocity. The thinner cross section of a rectangular feed configuration, for the same relative volume as a circular feed configuration, will tend to increase the number of stream lines that the fluid will travel through prior to exiting the generator. This desirably increases the centrifugal force. From a structural standpoint, the housing 42 may be cast as described above and the feed into housing 42 can be the same as illustrated in FIG. 2D above. As the flow enters passage 45 it moves from the circular passage into the rectangular configuration of passage 47. The flow which is moving towards the generator enters a converging section and ultimately enters the vortex generator at rectangular entry port 43, affording the multiple stream lines that the fluid will travel through prior to exiting the nozzle 10. As stated above, the term involuted injection is herein utilized as a specific type of tangential injection that may be utilized in certain applications.

Figure 7B:
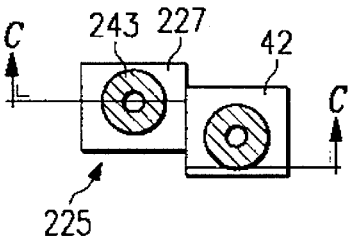
Figure 7C:
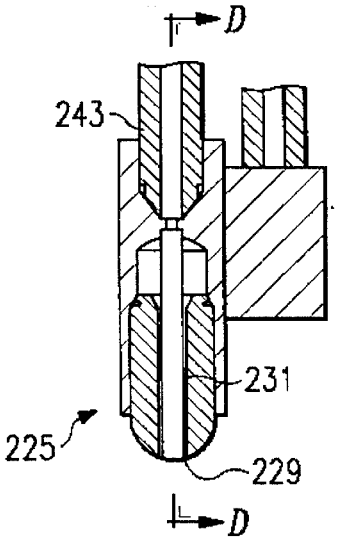
Figure 7A:
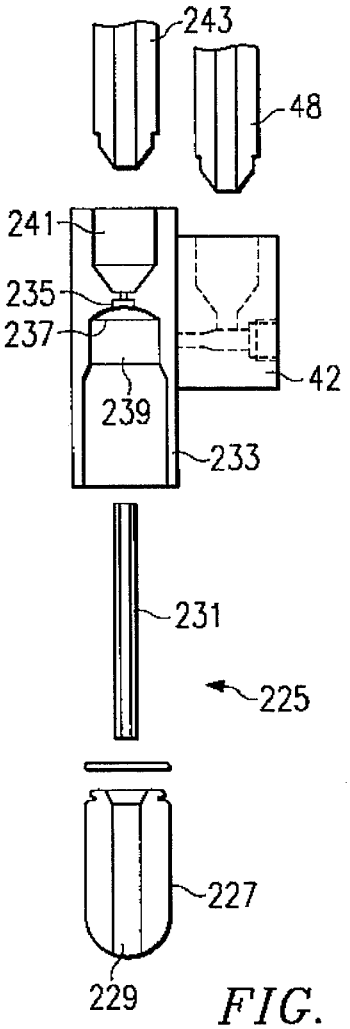

Referring now to FIGS. 7A–7E, there is shown an alternative embodiment of the nozzle 10 of FIG. 2A–2E. FIG. 7A is an exploded, diagrammatical, cross-sectional view of a nozzle 225. The elongate nozzle cutter 227 has an enlarged orifice 229 to permit the receipt of a tubular feed member 231. The construction of cutter 227 is substantially identical to the construction of bullet-shaped member 200 of FIG. 2C in other respects. The tubular member is adapted for being received within sleeve 233 for the introduction of abrasive particles of the type described above. The sleeve 233 is thus constructed with an upper feed passage 235, formed in the upper end 237 of swirl cavity 239. A tapered port 241 is constructed in flow communication with passage 235 and adapted for matingly receiving (or otherwise engaging) a feed line 243. The feed line 243 may be formed of seamless, austenitic stainless steel tubing, and is adapted for the flow of abrasive particles to flow pass age 235 and tubular member 231 in a manner to be described below. In this assembly, the remaining feed sections are substantially identical, including feed line 48 and the adjacent, rectangular block 42.

Referring now to FIG. 7B, there is shown a top plan view of the nozzle 225. Block 42 is shown disposed adjacent modified housing 227 with abrasive feed line 243 upstanding therefrom. From this view, FIG. 7C is seen as a side elevational, cross-sectional view of the nozzle 225 of FIG. 7B, taken along lines C—C thereof. The tubular member 231 is shown to be disposed within aperture 229 and in direct flow communication with feed line 243. In this manner, abrasive material may be discharged directly into the vortextural effluent without causing significant disruption or excessive internal wear thereto.

Referring now to FIG. 7D, there is shown a side elevational, cross-sectional view of the assembly 225 taken along lines D—D of FIG. 7C. The elliptical formation of tangential orifice 251 may be seen for the flow of liquid therein and around feed tube 231. In this position, the feed tube 231 still permits the egress of the swirling vortex from the cutter nose. FIG. 7E further illustrates this tubular relationship. FIG. 7E is a top plan cross-sectional view of the nozzle 225 of FIG. 7D taken along lines E—E thereof. In this view, the tangential entry and the position of the tubular member 231 is shown axially disposed within the central aperture 229 of housing 227.

Figure 8F:
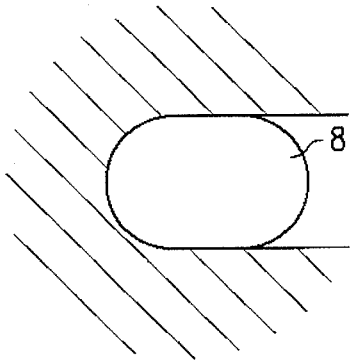

Referring now to FIG. 8, there is shown the operation of nozzle 10 in engagement with the formation 12. As is true with any fluid jet, the energy of the jet will degrade exponentially with increased distance from its nozzle exit. The present invention thus provides a method of constructing the exhaust tube of the vortex jet 10 in position for placement close to the target surface. The cutter designs illustrated herein permit the placement of the distal end of the nozzle cutter and the spinning liquid vortex jet immediately adjacent to the target formation 12 to take advantage of the highest jet energy levels possible. The use of a mechanical cutter as the discharge nozzle 10 provides the basis for employing the maximum hydrodynamic energy effects immediately adjacent to, and in combination with, the stress and/or fracture propagation action of the mechanical cutter. This combination, and its variants, of the jet erosion mechanisms coupled with the cutter/nozzle mechanical cutting mechanisms, effectively merges additional hydraulic erosion and mechanical cutting mechanisms to produce a significant increase in cutting ability.

FIGS. 8A and 8B illustrate the action of the vortex jet and cutter combination in reference to the fracturing and erosion of the formation 12. As the housing 11, supporting the nozzle 10, is rotated about its axis, the protruding nozzle cutter 15 is forced against and into the formation 12, synergistically merging the mechanically induced formation stresses, developed by the cutter gouging, fracturing and shearing, with the crack propagating hydraulic energy of the high speed vortex jet stream. The use of a hard material such as tungsten carbide to form the nozzle cutter 15 or a hard surface material, such as polycrystalline diamond or cubic boron nitride, on the nose 13 will provide erosion protection for the nozzle from the mechanical abrasion erosion of the formation 12 as it is engaged by the nozzle cutter 15 while additionally providing protection from jet derived splash back erosion normally associated with high speed jet actions. As the jet is forced onto or into the formation by the mechanical action of the particular cutting tool comprising housing 11, the relatively large diameter of the nozzle cutter 15 provides a splash back deflection shield that deflects the splash back action of the vortex jet stream away from the critical components that retain the nozzle cutter in place in housing 11. This is a significant improvement as prior art jetting apparatus must provide for this type of protection over a much larger area due to the stand-off required for their nozzles, which makes the nozzles and nozzle carriers susceptible to the significant problem of direct splash back erosions effects.

Referring now to FIGS. 1 and 8A and 8B in combination, the nozzle cutter 15 has been illustrated as a hemispherically shaped nozzle cutter. However, most shapes provided for cutting tools to effectively cut may suffice in this region. As shown in FIGS. 1 and 8B, the hemispherically shaped nozzle cutter face 16 in this embodiment is ideal for the inter-kerf wedging effects it would produce while constantly shifting the face of the nozzle cutter point of contact with the formation due to the infinitely changing rake angles of the hemispherical shape. This produces the effect of moving the formation materials away from the center of the nozzle cutter in all planes. The hemispherical shaped nozzle cutter face 16 provides formation fracturing between the kerfs 24 and 26 by exerting downward and lateral forces on the lands 17 and 19 in the forward and lateral planes. The hemispherically curved distal surface of the nozzle cutter 15 provides maximum formation fracturing, gouging, work hardening and shearing assistance for the jet action while exhibiting requisite cooling efficiencies. The nozzle cutter 15 further provides significant thermal stress reduction normally associated with mechanical cutters. This cooling is accomplished through internal cooling as the vortex jet flows through the nozzle cutter center flow path drawing heat from the nozzle cutter 15 and housing 30 as well as the exterior cooling derived from the immediate proximity of the jet which will provide forced exterior cooling of the nose 13. This significant reduction in thermal stress degradation will allow higher relative weights and/or higher RPM to be carried by nozzles 10.

Referring now to FIG. 8B, there is shown a sectioned elevation view of the vortex jet phase changes at various stages of its degradation as indicated by sections AA, BB, CC and DD shown therewith. Section AA illustrates the vortex jet 65 shortly after exiting the nozzle cutter 15. At this distance the jet is still fully formed with the same relative cross-sectional area as is developed in the discharge aperture 18. It is in this region that the combination of hydraulic fracture propagation, pressure reversal erosion, abrasive erosion and in situ intergranular cavitation are acting at their maximum values. It can be clearly seen that the vortex jet 65, due to its rotational motion, provides a relatively longer duration of the hydraulic/abrasive erosive forces at a given distance from the nozzle cutter exit than would be exhibited with an axial jet.

Section BB illustrates the vortex jet 65 approximately 5 to 10 nozzle diameters after exiting the nozzle cutter. At this distance the jet 65 is still formed, although deforming in shape. This region exhibits the combination of hydraulic fracture propagation, pressure reversal erosion, abrasive erosion and in situ intergranular cavitation. These forces are acting in this region at somewhat lesser values. The center core cavity is also shown to be collapsing in response to degradation of the flow region 9 which begins to expose the core region to the ambient pressures. It is in this region that the cavitational erosion may be at its highest values due to the relatively large volume of collapsing core. Between regions BB and CC the pressure relationship is adjusted to the point where the long trailing vapor filled cavity forms and sheds vapor cavities 67 from its tail 65. These vapor cavities 67 are convected with the circumferential and axial degrading vortex flow to a point where they collapse against the formation in response to ambient pressure as illustrated in CC and DD.

Illustrated in DD is flow region 8 which now exhibits only large helical motion and expends the residual energy in cuttings scavenging and sweeping the fractured lands to the adjacent cutting tool junk slots for removal. In this fashion, the vortex jet nozzles 10 are used in generating slots and fracturing of the lands between the slots to complement the action of the mechanical cutters.

Figure 9:
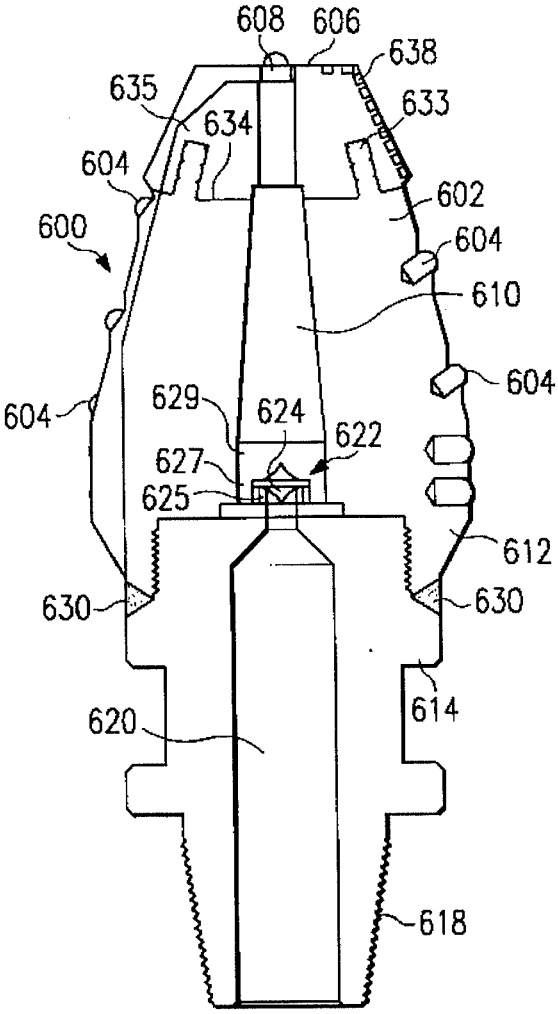
FIG. 9 is a side-elevational cross-sectional view of one embodiment of a jet cutter constructed in accordance with the principles of the present invention.

Referring now to FIG. 9, there is shown one embodiment of a jet cutter constructed in accordance with the principles of the present invention. The jet cutter of FIG. 9 is of the swirling vortex type and is constructed as part of a drill bit 600 having a tapered body section 602 and a plurality of cutting elements 604 extending outwardly therefrom. The tapered body section 602 is constructed with a narrow end portion 606 in which single aperture 608 is formed. The single, generally axially disposed aperture 608 comprises the distal end of an internal chamber 610 disposed within the housing 602. The chamber 610 may be tapered as in FIG. 9 for swirling flow or generally cylindrical for a nonswirling jet discharge. In either embodiment chamber 610 is adapted for receiving the flow of fluid therethrough. Also in one embodiment (FIG. 10), the aperture 608 is offset from the center of drill bit housing 600, but in the present illustration of FIG. 9 it is centrally aligned. The term "generally axially disposed" refers to the fact that aperture 608 may be offset (FIG. 10) or axially aligned (FIG. 9).

Still referring to FIG. 9, the upper region of the tapered body 602 comprises a generally cylindrical portion 612 which is adapted for receiving a pin section 614 of the drill bit housing 600 in which a threaded section 618 is formed on the end thereof. Threaded section 618 is preferably formed with a typical API oil field thread designed for the bit's attachment to the drill pipe. Any conventional threaded configuration would, of course, be appropriate in accordance with the principles of the present invention. What is provided is a section 614 having a central bore 620 formed therethrough, said bore 620 being in flow communication with the chamber 610 formed in tapered body section 602. The region between bore 620 and chamber 610 further includes (in the vortex flow embodiment) a swirler section 622 having a swirl stator 624 and stator vanes 625 disposed therein. Swirl stator 624 is secured to the body 614 by bonding, brazing, welding or forming it in place. The construction of a fluid swirling mechanisms of the general type used in section 622 is common in the air conditioning industry which utilizes vortex air conditioning units to sort dust particles out of the processed air hydrocyclones to sort entrained particles from liquids in the mining and oil industries. Stator 624 is made of steel, cemented tungsten carbide or a ceramic material and provides a means for imparting rotation to the fluid discharged through bore 620 into tapered bore 610. Conventional materials such as steel or cemented tungsten carbide may be utilized in the construction of the various cutter elements listed herein as is conventional in the manufacture of oil tooled equipment. The bit body 602 is, for example, preferably, constructed with a titanium alloy for providing strength. The body 614 is secured to the tapered body 602 by welding, as represented herein by weldament 630.

Still referring to FIG. 9, the construction of the bit 600 of the present invention from material such as a titanium alloy is also for purposes of anti-bit balling in shale-like formations. Such material does not wet the same as a ferrous-type metal and, therefore, does not attract shale and the like. Moreover, one feature of the titanium construction of the present invention is the ability of the material to be surface treated by ion-nitrating which provides an extremely tough ceramic coating on the material to resist abrasive erosion. In addition, the material has a modulus of elasticity which is much greater than steel and its fatigue resistance is, therefore, much greater. The cutting elements 604, as described above, are insert-type cutters. These are mechanical cutters which may be of the flowing or non-flowing variety. The flowing variety may be of the type described above in FIG.

2 or FIG. 7. The non-flowing, mechanical cutter is the only cutter configuration shown in this particular embodiment of the present invention. Such cutters 604 may be pressed, brazed or welded into the body 602. A mating section 633 is formed on the end 634 of body 602 to provide a mandril for forming and securing a nose section 635 thereon. Nose section 635 is preferably made from cemented tungsten carbide or the like to provide a drilling nose that may be mounted with diamonds 638 for engaging the drilled formation. The diamonds 638 are preferably thermally stable. The diamonds and the tungsten carbide are formed either by an infiltration technique or a desensification technique which is hydraulically formed to mechanically secure and bond to the thermally stable synthetic diamond material to form an integral piece on the tool 600.

Referring still to FIG. 9, the tapered chamber 610 provides a converging cone leading to discharge orifice 608 which will reduce the centered, swirling vortex flow of the drilling fluid down to its highest rotational velocity generating the above-referenced cavitation filament. The advantages of cavitation are described above. More specifically, the drill fluid enters the cylindrical bore 620, and travels through the stator 624 and the stator vanes 625 into an exiting area 627, into the cylindrical region 629 of the tapered chamber 610. It is in this region 629 in which the initial conditions for the angular momentum of the fluid issuing from the orifice 608 are established, which angular momentum is conserved as the fluid constricts down to the discharge orifice 608. The swirler region 622 as described herein thus provides a drill bit 600 having a single discharge orifice 608 with the swirling cavitational flow described above. It is this flow which may be used specifically to induce the cavitational cutting from the tapered drill bit 600 in accordance with the principles of the present invention.

Figure 10:
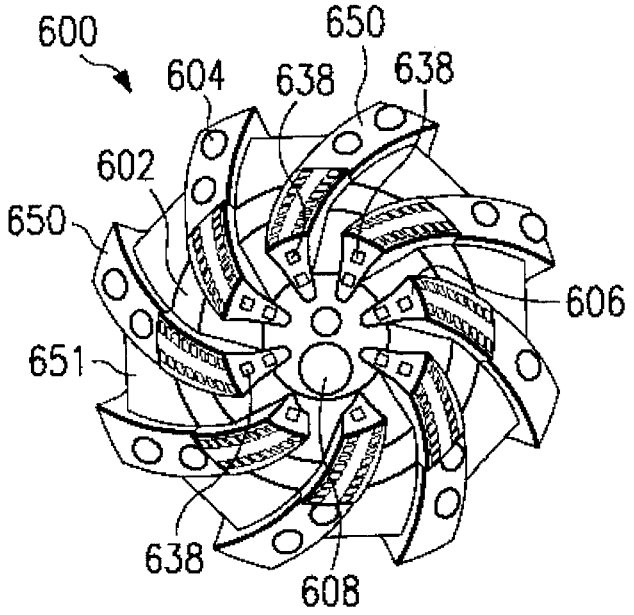
FIG. 10 is an end-elevational view of the jet cutter of FIG. 9 taken from the right side thereof.

Referring now to FIG. 10, there is shown an end-elevational view of the tapered bit 600 of FIG. 9 taken from the end 606 thereof. The orifice 608 in this particular embodiment is offset and is clearly shown to be simply disposed about the cutter nose 606 with the synthetic diamonds 638 located therearound. The synthetic diamonds 638 also are disposed upon sections of the cutter which are provided along the outer surface thereof. In that regard, arcuately formed cutting ribs 650 are constructed with cutting elements 604 extending outwardly therefrom as well as the diamond 638 embedded in the frontal region thereof. As the cutter body 602 is rotated, the angulated ribs 650 provide mechanical cutting of the surface to be bored with the diamond element 638 and cutter elements 604 directly engaging said bored surface for the mechanical breaking thereof in combination with the fluid discharge from orifice 608. As stated above, the cavitational discharge orifice 608 may be offset from the center line or the distal end of the drill bit to allow for a greater swept volume of rock to be exposed to the cavitational attack. Also it may be advantageous to form more than one cavitational discharge orifice in the distal end of the drill bit. In combination, the swirling fluid discharge from orifice 608 erodes and abrades the formation being cut and lubricates the area being penetrated for engagement with the rotating mechanical cutter of ribs 650. This particular embodiment includes junk slots 651 disposed between ribs 650 for allowing the drilling fluid to carry away debris outwardly therefrom during the rotation of the body 602. The fluid flowing through the bit 600 will then flow upwardly through the annulus (shown in FIG. 12) of the well bore. The drill string provides drilling fluid directly to the drill bit body 602 for discharge from the orifice 608 in the swirling cavitational mode described above. All formation cuttings are thus passed upwardly through the annulus of the well bore as is conventional in modern drilling.

Figure 11:
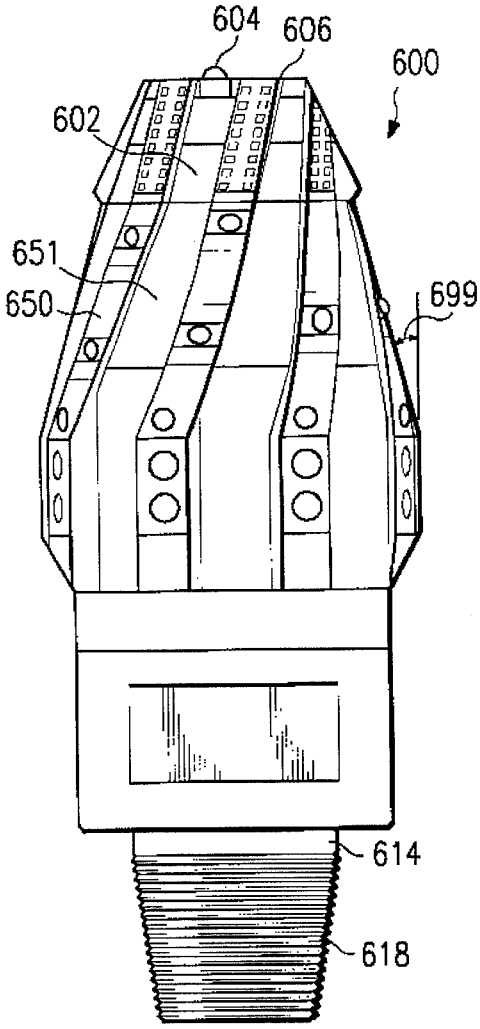
FIG. 11 is a side elevational view of the jet cutter of FIG. 9.
Figure 12:
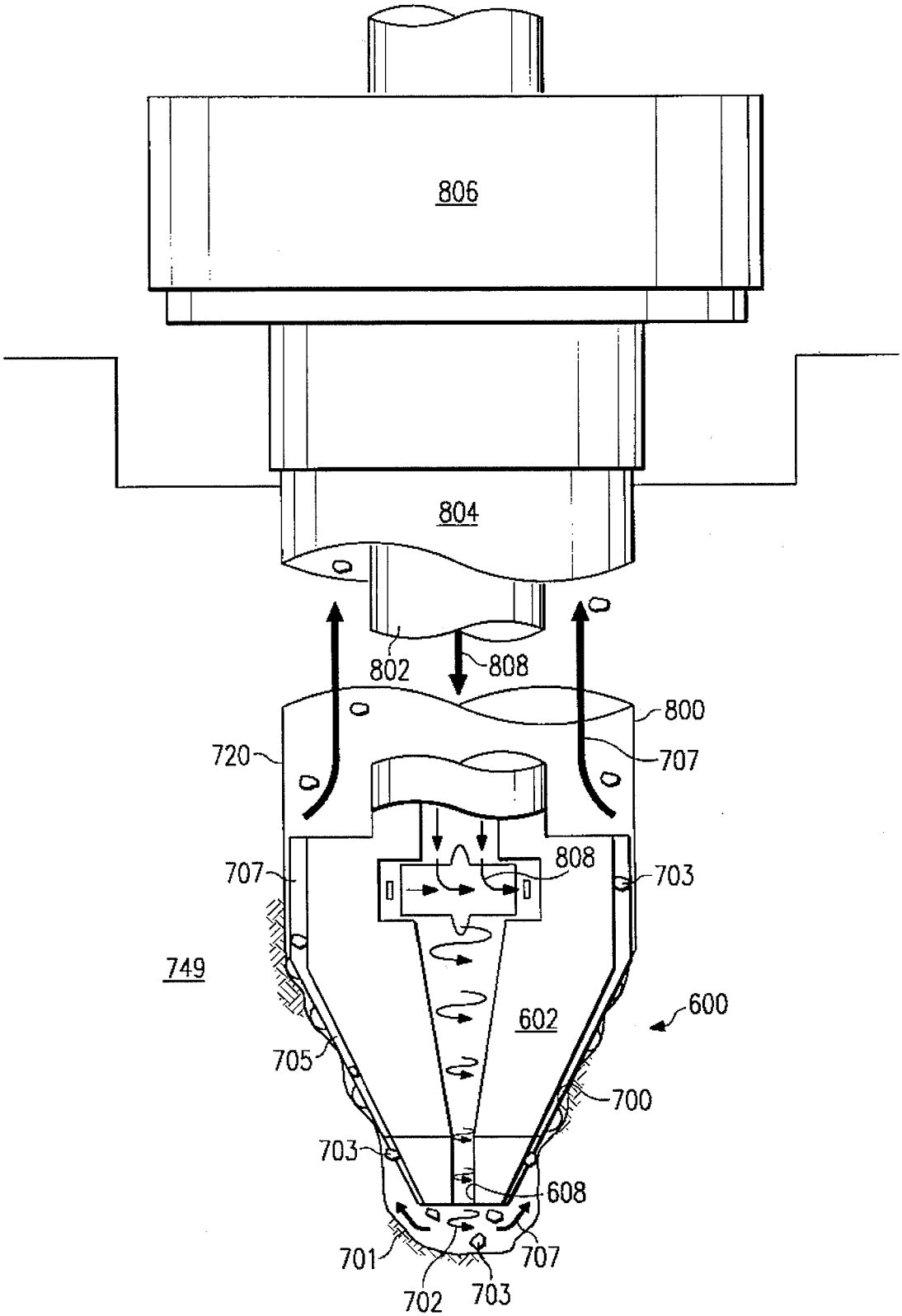
FIG. 12 is a side elevational, cross-sectional diagrammatic schematic of a bore hole illustrating a cutting configuration in accordance with the principles of the present invention.

Referring now to FIG. 11, there is shown a side elevational view of the bit 600 of FIG. 9, wherein the tapered body 602 is shown in more detail. A single cutting element 604 is shown on the end 606 at the terminal end of ribs 650 and junk slots 651. The taper of body 602 may vary. A taper angle 699 is shown in FIG. 11 to be on the order of 25°, but could vary between 5° to 60°, as generally shown in FIG. 12, depending on the particular cutting application. The threaded section 618 formed around section 614 then provides means for mounting the tapered bit 600 (of a given taper) to the drill string. Conventional oil field threads provide the necessary mating configuration.

One distinct advantage of the present invention is the utilization of conventional drilling fluid pump pressures to generate a drill bit vortex cavitational discharge that may be utilized in conjunction with an improved tapered cutting section 602 that will, in itself, remain centrally disposed within a bore hole to assist in the cutting thereof. More specifically, the cutting profile is improved by permitting the tapered section of bit 600 to have centrally disposed cavitational discharge, whereby the flow from the cavitational discharge may flow upwardly around the tapered section 602 in a manner consistent with more efficient and effective cutting and hole cleaning.

Referring now to FIG. 12, there is shown a side-elevational cross-sectional diagrammatic schematic of a bore hole 800 illustrating a cutting configuration in a formation 749 in accordance with the principles of the present invention. Drill pipe 802 is shown disposed within casing 804 depending from a well head 806. Drilling fluid 808 is pumped under pressure to the bit 600 and flows in the pattern shown therein.

Still referring to FIG. 12, it may be seen that the tapered body section 602 of bit 600 produces a tapered bore section 700 of bore hole 800 that has an enlarged bottom region 701 formed by the discharge of fluid jet 702 from orifice 608 of bit 600. The enlarged region 701 is formed by the combination of the swirling cavitational fluid of jet 702 and the mechanical crushing, fracturing of the distal end of the drill bit. The fluid from jet 702 then flows upwardly through the tapered annulus 705 defined between the sidewalls of the tapered body section 602 and the bore hole section 700 formed therefrom. The fluid flows upwardly in the direction of arrow 707 removing the cuttings 703 from around bit 600. The combination of the above described centered cavitational erosive cutting and the mechanical cutter elements 604 should induce a continuously greater level of combined crushing/shearing, formation contact point pressure reversals and differential tension stresses on the hole bottom and walls of well bore 800 than has been generated by conventional drill bits trying to crush the rock of the bottom of the hole where the presence of the highest resisting forces exist. The generally axially centered jet, cavitational erosive cutter should penetrate virgin formations through concentrating mechanical advantage of high horse power, high speed hydraulics with the mechanical crushing/shearing action of bit 600 of the present invention. This effect should overcome the combined insitu stresses of the virgin formation and generate a cylindrical bore hole 720 as shown herein. Hole 720 is enlarged from tapered hole section 700 by the advantageous force vectoring mechanical action of the side mounted crushing, shearing cutting elements 604 described above. At this point, cutting elements 604 are not acting against the insitu and hydrostatic confining forces and stress of virgin formation, but only in conjunction with the stresses that are acting to collapse the well bore wall. As the well bore stress field has been altered significantly by the removal of the over burden and replacement with a much less dense hydrostatic force, the well bore wall is much more easily overcome with the angular vectored mechanical crushing/shearing cutters of the sides of the bit 600. The larger than conventional tapered angle of the hole 705 provides a preferred angle of attack for the mechanical cutters due to the large unsupported section of the hole wall. The force reduction should be greater than three times that force delivered to crush the formation on the hole bottom to drill the well. Another feature of the tapered configuration is to minimize the effects of down hole drilling dynamic forces which comprise rotational slip stick effects which cause bit whirl and long drill string vibrational dynamics. The combined effects of these forces have proven to prematurely destroy many down hole tools.

The present invention minimizes the above-described dynamic forces through better stabilization of the drill bit 600 and by rendering a higher contact point surface area of the tapered bit body 602 to counter the effects of these forces. The tapered shape of body section 602 in conjunction with the erosive fluid jet 702 from orifice 608 should dynamically dampen these forces through superior bit stabilization and cutter contact dynamics to minimize vertical and lateral pounding of the drill bit as illustrated in FIG. 12. The effects of the erosive bit 600 then provide an enlargement of the eroded bottom region 701 around the cutter at a rate such that the controlling factor for rate of penetration is the ability of the side mechanical cutters 604 secured along the ribs 650 (described in FIG. 10) to mechanically crush/shear the well bore 720 to its gauge diameter.

Figure 13:
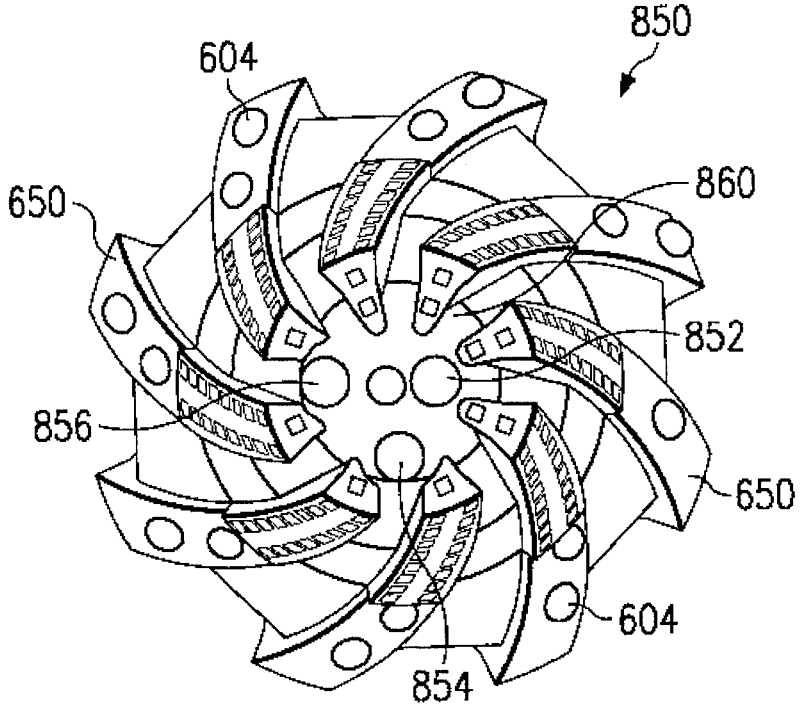
FIG. 13 is an end-elevational view of an alternative embodiment of the jet cutter of FIG. 9 illustrating the placement of multiple jets across the end thereof.

Referring now to FIG. 13, there is shown an alternative embodiment of the jet cutter of FIG. 9. Jet cutter 850 is formed with a plurality of offices 852, 854, and 856 formed in end 860. The plurality of orifices may be utilized in particular drilling applications wherein higher fluid flows, higher fluid pressures and/or the erosive cutting action is best spread out across the end 860. The remaining features of the cutter 850, such as ribs 650 and cutting elements 604, are not specifically discussed since they have already been described herein.

In summary, the above features of the tapered drill bit 600, single or multiple plenum discharge and the utilization of cavitational flow 702 in conjunction with the mechanical cutting of the cutting elements 604 in body 602 provides an improved drilling dynamic force arrester. In further explanation of the advantages, there are three types of phenomenon that act to destroy the cutter of conventional drill bits. These phenomenon include lateral instability, dynamic vertical pounding, and individual cutter loading as a result of the first two forces, individually or in combination. The side mechanical cutters 604 contact the formation 749 in a manner that provides multiple vertical engagement in a form that must be sufficient as to force crushing/shearing action to destroy the formation. This action will produce sufficient stability to counteract any or most of the lateral forces induced due to formation changes, or slip stick phenomenon. Further, and simultaneously, as the erosive cutter jet 702 can crush/shear/erode the formation 749 faster than the side mechanical cutters 604 can enlarge the well bore, any reciprocal vibrational movement induced by drill string dynamics will tend to be taken up by the side mechanical cutters 604 along tapered ribs 650. This design provides more bearing area due to the number of mechanical cutters 604 that can be employed in a tapered bit configuration and such forces acting on the cutters 604 will tend to be vectored forces into a partially stress relieved formation 749 as opposed to more conventional bits in which the cutters would be forced into the highest insitu formation forces. The combining of fluid and mechanical formation attack adjacent to each other provides mechanical forces to crush and fracture the formation being drilled concurrently with high speed cavitational flow to erode and scavenge. This combination should be extremely efficient in increasing the rates of penetration in all types of formations. As stated above, high speed [i.e., high pressure], non-swirling flow can be substituted for the forced vortex flow resulting in appreciable increases in the rate of penetration of formations.

It is thus believed that the operation and construction of the present invention will be apparent from the foregoing description. While the method and apparatus shown and described has been characterized as being preferred, it will be obvious that various changes and modifications may be made therein without due parting from the spirit and scope of the invention as defined in the following claims.

What is claimed is:

1. An improved cutting tool for the erosion of a surface, said tool being of a type wherein a liquid jet is discharged from said tool to create an eroded region, said improvement comprising:

a tapered tool body having at least one discharge nozzle disposed therein;

a plurality of mechanical cutting elements secured about said tapered tool body;

said discharge nozzle being formed on the distal end of said tool for initial engagement with said surface;

a chamber formed in said tool body and disposed in flow communication with said nozzle;

means for discharging said liquid from said chamber and through said nozzle against said surface for the erosion thereof; and means for rotating said tool during discharge of said liquid jet.

2. The apparatus as set forth in claim 1 and including a liquid swirl creation means for generating a swirling liquid jet, said creation means comprising a stator, said chamber being tapered and said stator disposed in flow communications with said tapered chamber for the generation of a liquid swirl therein.

3. The apparatus as set forth in claim 2 wherein said stator is disposed within a generally cylindrical chamber formed within said tapered chamber.

4. The apparatus as set forth in claim 1 wherein said jet is a swirling liquid jet and said liquid discharge means includes a tapered chamber disposed within said tool body and a liquid flow passage disposed in flow communication therewith for the injection of fluid into said chamber and the generation of a swirling flow therein.

5. The apparatus as set forth in claim 4 wherein said nozzle is constructed as part of a nose on the end of said tool body, said nose having an aperture formed therethrough adapted for the discharge of said swirling liquid jet therefrom.

6. The apparatus as set forth in claim 5 and further including said nose being constructed with a plurality of diamonds disposed therearound for mechanically abutting said surface to be eroded.

7. The apparatus as set forth in claim 1 wherein said nozzle is formed in the center of said tool body.

8. The apparatus as set forth in claim 1 wherein said nozzle is formed in a position offset from the center of said tool body.

9. The apparatus as set forth in claim 1 wherein a plurality of nozzles are disposed at the end of said tool body.

10. The apparatus as set forth in claim 1 and further including a plurality of cutting elements secured around said tool body for engaging said surface to be eroded for the penetration thereof.

11. The apparatus as set forth in claim 1 and further including said tool body being constructed of titanium.

12. The apparatus as set forth in claim 11 in which the surface thereof is ion-nitrated.

13. The apparatus as set forth in claim 1 wherein said tool is a drill bit for drilling a bore hole in the earth.

* * * * *